United States Patent [19]

Filipowicz et al.

[11] 4,358,169

[45] Nov. 9, 1982

[54] DISPENSER FOR COILED SHEET MATERIAL

[75] Inventors: Edwin A. Filipowicz, Greenfield; Robert W. Cornell, Hales Corners, both of Wis.

[73] Assignee: Griffith-Hope Company, West Allis, Wis.

[21] Appl. No.: 171,888

[22] Filed: Jul. 25, 1980

[51] Int. Cl.[3] ..... B65H 19/00; B65H 19/06

[52] U.S. Cl. ..... 312/39; 312/38; 242/55.3; 242/55.53

[58] Field of Search ..... 312/39, 40, 41, 38; 242/55.3, 55.53, 58; 26/105

[56] References Cited

U.S. PATENT DOCUMENTS

| | | | |
|---|---|---|---|
| 3,007,650 | 11/1961 | Burton | 242/55.53 |
| 3,140,060 | 7/1964 | Layton et al. | 242/55.53 |
| 3,628,743 | 12/1971 | Bastian | 312/39 |
| 3,672,552 | 6/1972 | Krueger et al. | 312/39 |
| 3,917,191 | 11/1975 | Graham, Jr. et al. | 242/58 |
| 4,010,909 | 3/1977 | Bastian | 242/55.3 |
| 4,021,894 | 5/1977 | Poterala et al. | 26/105 |
| 4,067,509 | 1/1978 | Graham, Jr. et al. | 242/55.3 |
| 4,165,138 | 8/1979 | Hedge et al. | 312/39 |

FOREIGN PATENT DOCUMENTS

| | | | |
|---|---|---|---|
| 165354 | 6/1921 | United Kingdom | 312/38 |

*Primary Examiner*—Victor N. Sakran

*Attorney, Agent, or Firm*—Andrus, Sceales, Starke & Sawall

[57] ABSTRACT

A dispenser for coiled sheet material, such as paper towelling, having an improved transfer mechanism for transferring feed from a partially consumed roll of sheet material to a fresh or reserve roll. The sheet from the partially consumed roll is fed across an apron to a pair of cooperating feed rolls. The transfer mechanism comprises a sensing finger carried by a pivotable frame which rides on the sheet material being dispensed from the partly consumed roll. When the end of the sheet material moves past the finger, the finger being unsupported, will drop through an opening in the apron to thereby pivot the frame downwardly and cause a roller to move the free end of the sheet of the reserve roll into the nip between the feed rolls so that the sheet from the reserve roll will then be fed from the dispenser. A pivotable discharge plate is mounted at the discharge opening of the dispenser and can be pivoted between a controlled feed position and a free feed position. When in the controlled feed position, only predetermined lengths of the sheet can be dispensed, but when the plate is in the free-feed position, a continuous length of sheet can be dispensed.

6 Claims, 11 Drawing Figures

FIG. 7
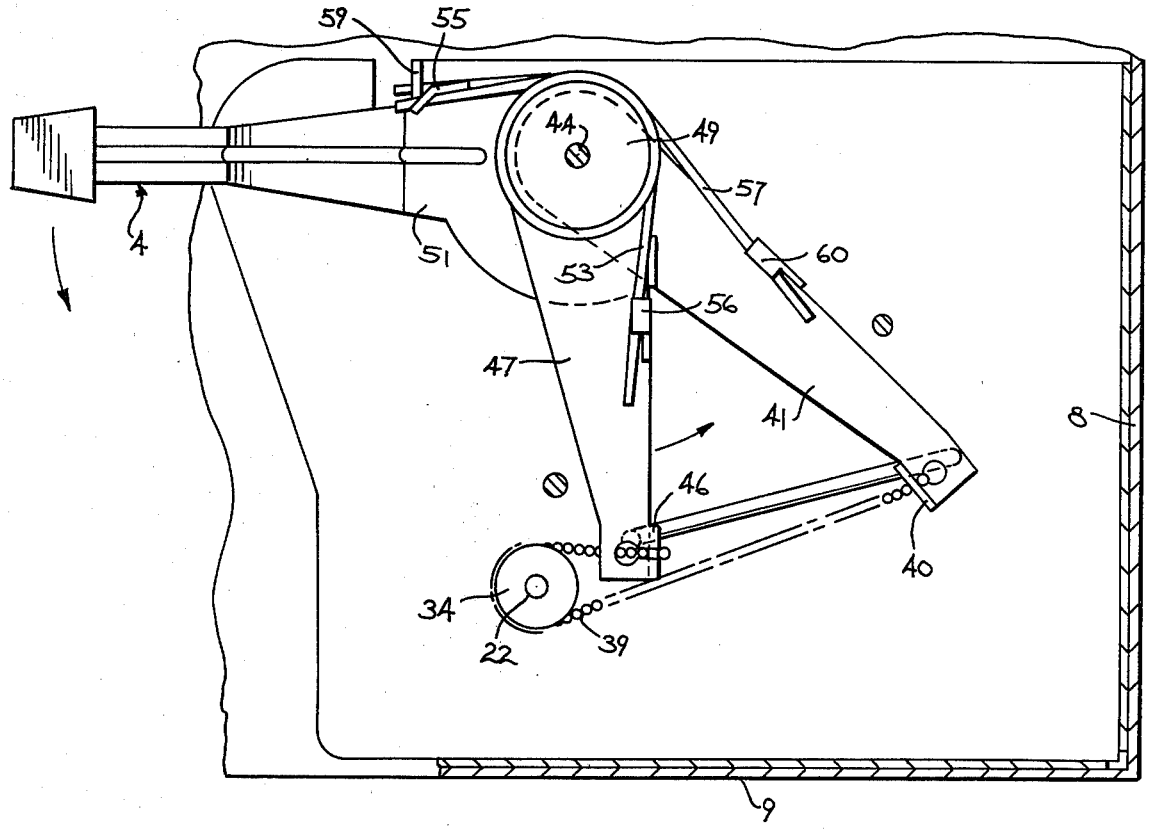
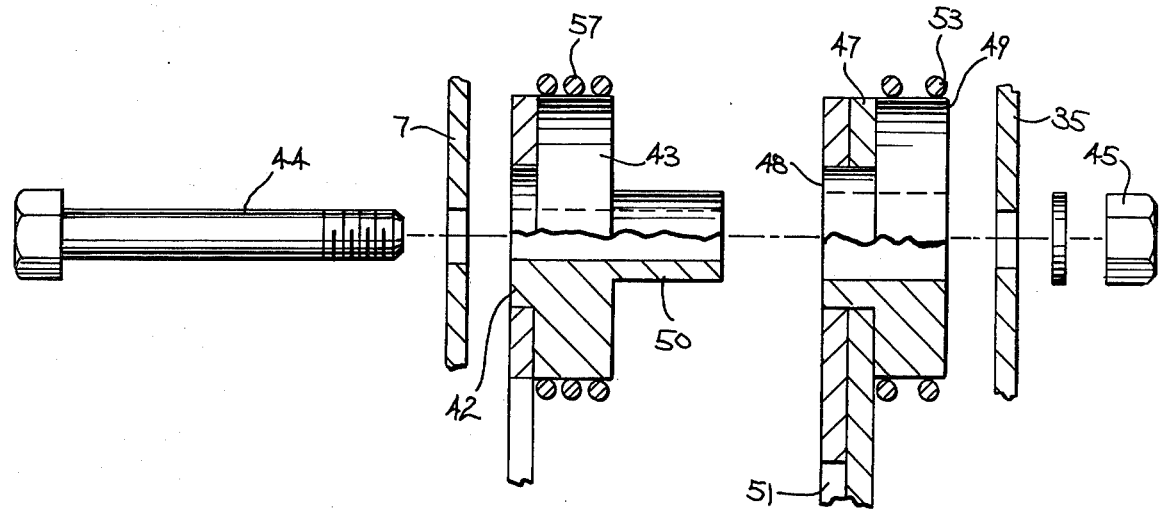
FIG. 8

DISPENSER FOR COILED SHEET MATERIAL

BACKGROUND OF THE INVENTION

Paper towel dispensers contain a roll of paper towelling which is fed from the dispenser through a discharge opening by operation of a pair of cooperating feed rolls. In the conventional dispenser, the feed rolls are operated by manual movement of a crank or lever on the side of the dispenser.

Recently, dispensers have incorporated a provision for automatic transferring feed from a partially consumed roll to a fresh or reserve roll. In dispensers of this type, as shown in U.S. Pat. Nos. 4,104,684, 4,165,138 and 3,628,743, the partially consumed roll is mounted in a cradle in the lower portion of the dispenser and the sheet is fed through cooperating feed rolls to the discharge opening. A fresh or reserve roll is mounted in a cradle above the partially consumed roll, and the free end of the sheet of the fresh roll is normally draped above the feed rolls. In dispensers of this type, a transfer mechanism is utilized which will automatically transfer feed to the reserve roll when the partially consumed roll is fully depleted. In some cases the transfer mechanism senses the diameter of the partially consumed roll and will transfer the feed when the diameter has been reduced to a predetermined value. In other transfer mechanisms, such as shown in U.S. Pat. No. 4,165,138, a sensing finger rides on the sheet being dispensed from the partially consumed roll and senses the end of the sheet. When the end of the sheet is drawn beyond the sensing finger, the finger will drop into a groove in one of the feed rolls to actuate a transfer finger which moves the free end of the sheet of the reserve roll into the nip between the feed rolls, so that the reserve roll is then fed by the feed rolls.

SUMMARY OF THE INVENTION

The invention is directed to a dispenser for sheet material, such as paper towelling, which includes an improved transfer mechanism for transferring feed from the partially consumed stub roll to the fresh or reserve roll.

The sheet from the partially consumed roll is fed across a shelf or apron to the cooperating feed rolls, and a sensing finger is located above the apron and normally rides on the sheet as the sheet is being dispensed. When the end of the sheet is drawn past the sensing finger, the finger will drop by gravity through an opening or notch in the apron, thereby pivoting the frame downwardly and causing a transfer roller to move the free end of the sheet of the reserve roll into the nip between the feed rolls. The free end of the sheet of the reserve roll will then be fed through the feed rolls and discharged through the discharge opening in the dispenser.

The dispenser also includes a provision for changing the feed from controlled feed to free feed. A dispenser is normally set up for controlled feed in which actuation of the lever or crank on the dispenser will dispense a given length of towelling from the cabinet and it is not normally possible for the user, by grasping the dispensed end of the towelling, to pull a continuous length of towelling from the cabinet. In some installations, however, it may be desirable for the user to dispense a continuous or longer length of towelling. In the dispenser of the invention, a pivotable discharge plate is mounted at the discharge opening or mouth of the dispenser and is movable between a controlled feed position and a free feed position. When the discharge plate is in the controlled feed position, the towelling being discharged will pass over the plate in a generally horizontal attitude and pulling on the dispensed length of towelling will cause the towelling to engage a serrated cutter blade to sever the sheet.

When the discharge plate is moved to the free feed position, the towelling will pass beneath the plate and is discharged in a generally vertical attitude. In this situation, pulling downwardly on the towelling will cause a continuous or additional length of towelling to be dispensed, and the dispensed length can then be severed by pulling outwardly or horizontally.

In the construction of the invention, the feed roll is provided with a series of spaced resilient collars, each of which is provided with a plurality of diagonal or herring-bone ribs. The herring-bone ribs serve to center the sheet or towelling and stretch the sheet laterally to remove wrinkles from the sheet as it is being dispensed.

Other objects and advantages will appear in the course of the following description.

DESCRIPTION OF THE DRAWINGS

The drawings illustrate the best mode presently contemplated of carrying out the invention.

In the drawings:

FIG. 7 is a side elevation of the operating lever feed mechanism;

FIG. 8 is an exploded view of the shaft construction for the operating lever mechanism;

DESCRIPTION OF THE PREFERRED EMBODIMENT

Figure 1:
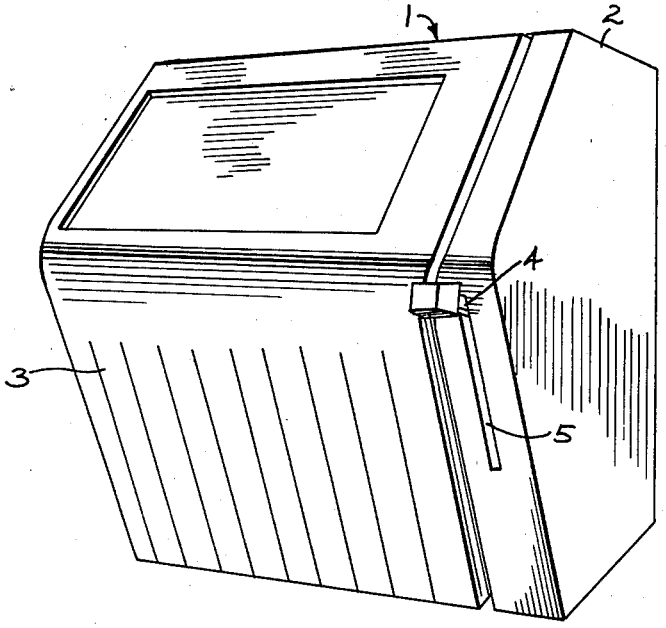
FIG. 1 is a perspective view of the dispenser.

FIG. 1 illustrates a dispenser 1 for a rolled product, such as paper towelling, toilet tissue, or the like, which includes an outer cabinet or housing 2 and a front cover 3 which is hinged along its lower edge to the cabinet 2. An operating lever 4 extends outwardly through a slot 5 in the cover, and by pushing downwardly on the lever, a predetermined length of the towelling or other sheet material, will be dispensed from the dispenser 1.

Figure 2:
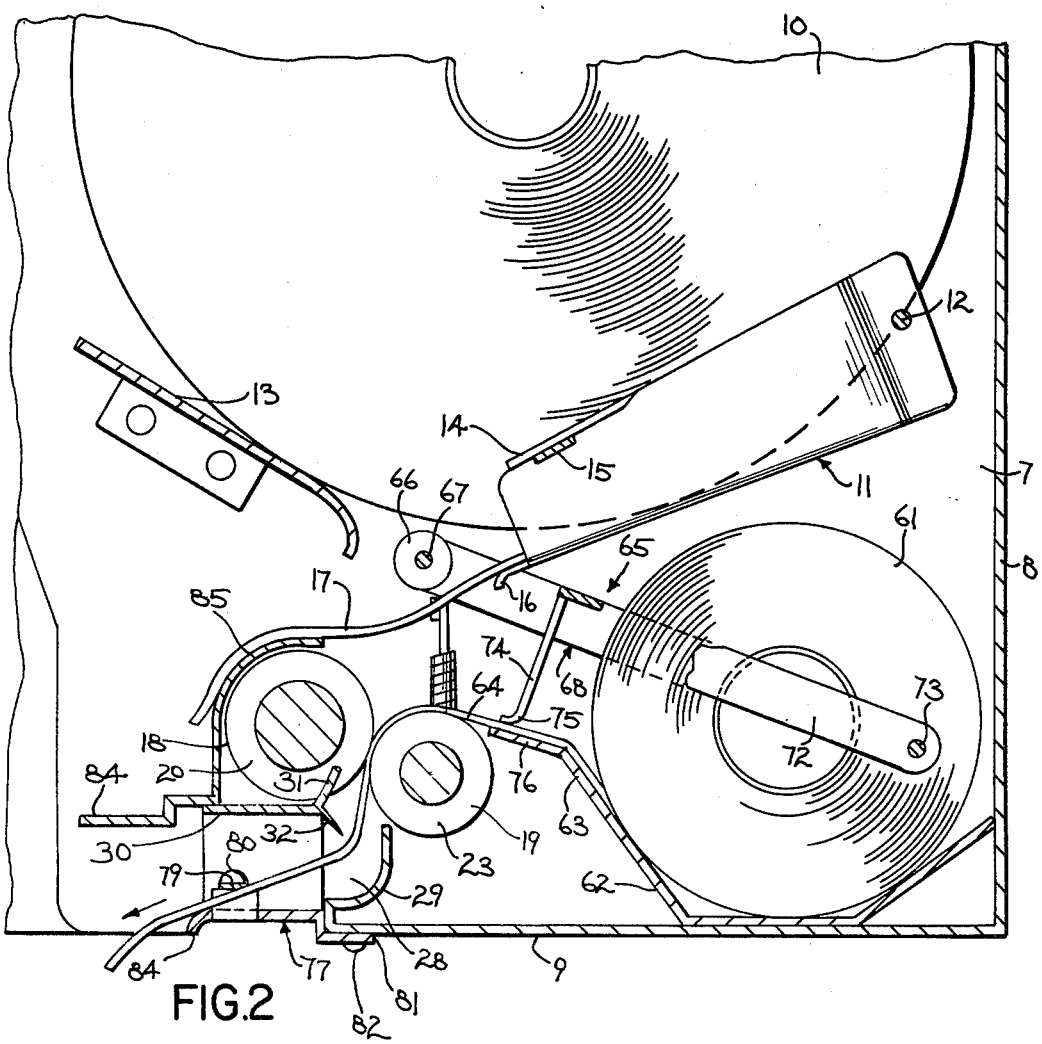
FIG. 2 is a vertical section of the dispenser showing the partially consumed roll being dispensed in the controlled feed manner.

Located within the cabinet 1 is a frame 6 which is composed of a pair of generally vertical side walls 7, a rear wall 8 and a bottom wall 9. A fresh or full roll 10 of towelling is supported on a cradle 11, which is pivoted to the side walls 7 of frame 7 by pins 12, and a tray 13 that is located forwardly of the cradle and is attached to the side walls 7. The sides of the cradle 11 flare outwardly to provide laterally extending flanges 14 that are adapted to rest on tabs or abutments 15 secured to the side walls 7 to retain the cradle in a downwardly extending supporting position, as shown in FIG. 2. The forward edge of the cradle is provided with a rolled lip 16. When the roll 10 is removed from the cradle 11, the cradle can be pivoted upwardly about pins 12 to gain access to the components beneath.

Figure 4:
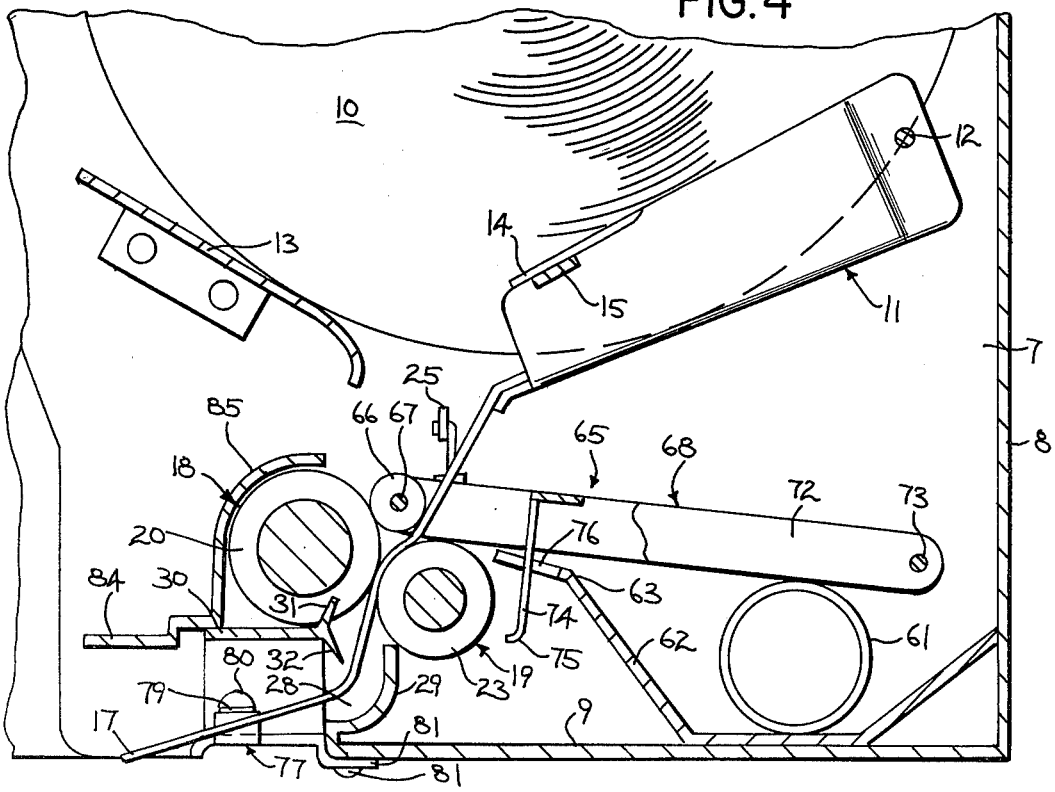
FIG. 4 is a view similar to FIG. 3 showing the transfer of feed to the fresh roll.

When the roll 10 is being dispensed, as shown in FIG. 4, the free end of the towelling or sheet 27 passes downwardly over the rolled lip 16 between a feed roll 18 and a pressure roll 19. Rotation of the feed roll 18 will act to draw the sheet 17 from the roll 10.

Figure 5:
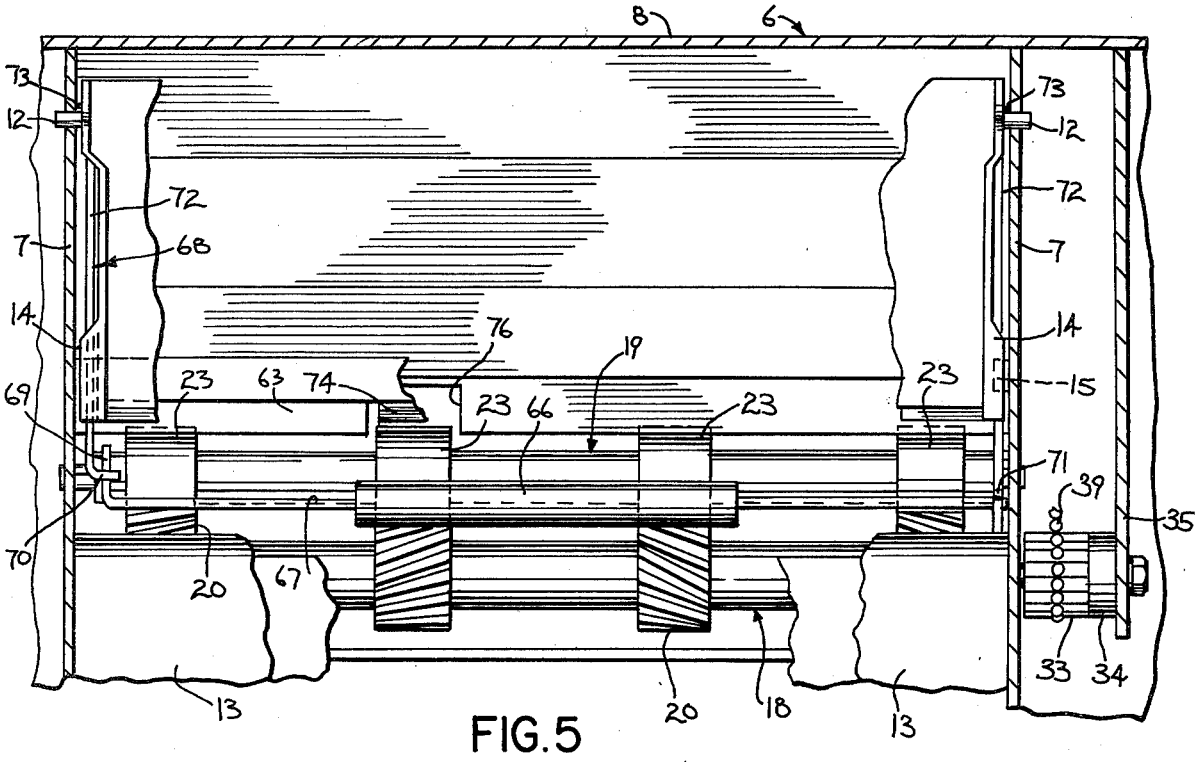
FIG. 5 is a top view with parts broken away of the dispensing mechanism.
Figure 6:
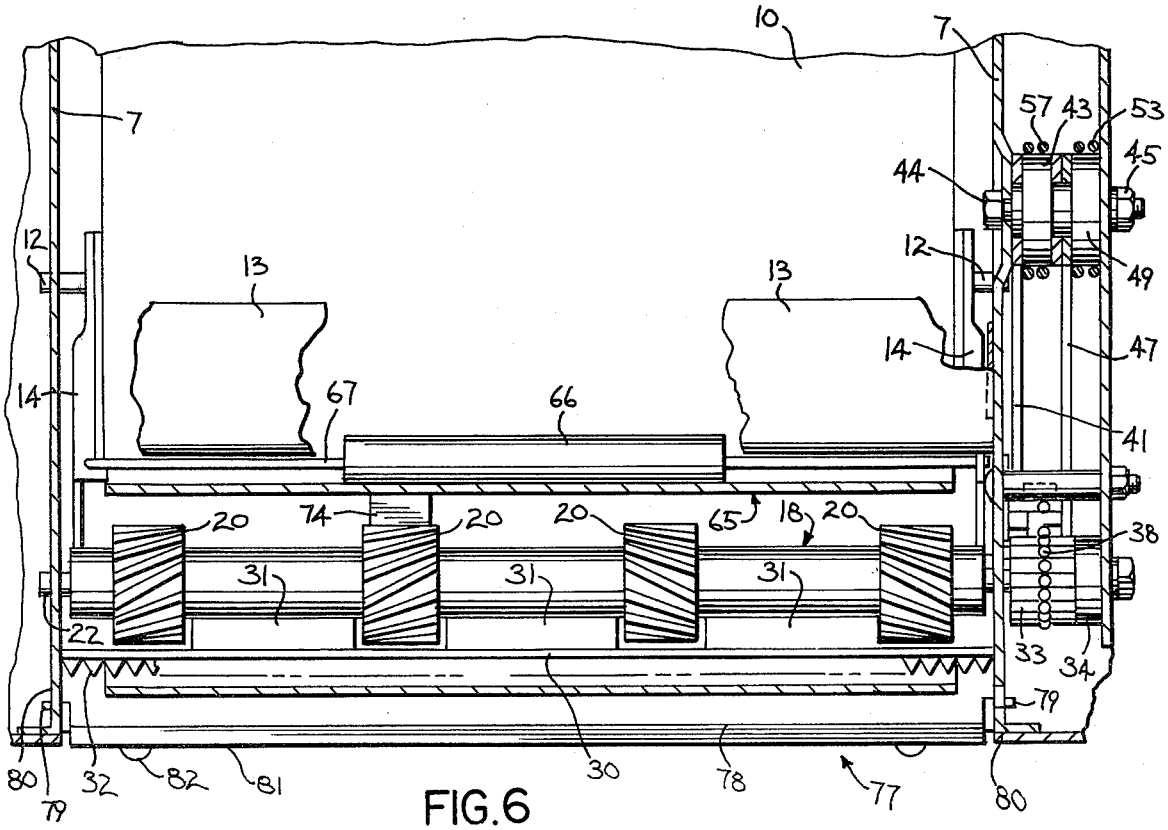
FIG. 6 is a front view of the dispensing mechanism.
Figure 9:
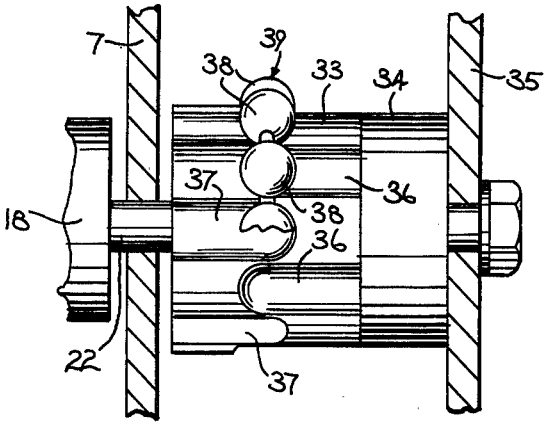
FIG. 9 is an enlarged vertical section showing the bead chain and sprocket drive for the feed rolls.

As best illustrated in FIGS. 5 and 6, the feed roll 18 is provided with a series of resilient collars 20, formed of rubber or the like, which are spaced along the length of the feed roll. Each of the resilient collars 20 is provided with a series of parallel herring-bone ribs 21. As shown in FIG. 6, when viewing the feed roll 18 from the front, the ribs 21 of the collars 20 on the left hand side of the roll are inclined in the opposite direction from the ribs 21 on the right hand collars 20. This herring-bone arrangement serves a dual function in that it acts to stretch the sheet 17 laterally to remove wrinkles from the sheet, and it also centers the sheet on the feed roll.

The ends 22 of the feed roll 18 are journalled in the side walls 7 of the frame, and one of the ends 22 is connected to an operating mechanism, as will be hereinafter described, which serves to rotate the feed roll 18 and thereby dispense a given length of the sheet 17.

The pressure roll 19 is formed with a series of enlargements or collars 23 which are disposed in alignment with the resilient collars 20 on the feed roll 18, and the sheet 17 is fed between the aligned collars 20 and 23.

Figure 10:
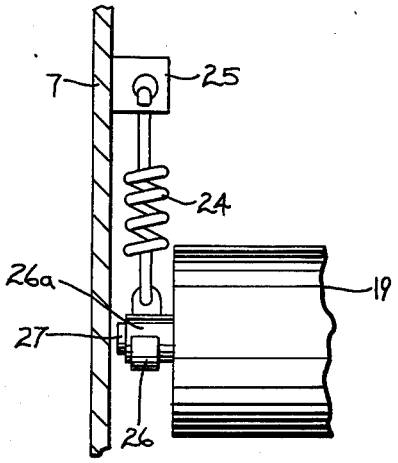
FIG. 10 is a fragmentary, enlarged vertical section showing the connection of one of the feed rolls to the frame.

The pressure roll 19 is biased upwardly into engagement with the feed roll 18 by a spring mechanism, as shown in FIG. 10. The upper ends of extension springs 24 are attached to tabs 25 secured to the side walls 7 and the lower ends of the springs carry J-brackets 26 which serve to support bearings **26*a* that journal the pressure roll shaft 27 for rotation. With this construction, the springs 24 act to urge the pressure roll 19 into engagement with the feed roll, as well as permitting the roll 19 to move relative to the feed roll 18** to accommodate various thicknesses of the sheet being dispensed.

The sheet 17 being fed through the rolls 18 and 19 is discharged from the cabinet through a discharge opening 28 which is defined by a generally curved chute 29 which extends laterally between the side wall 7 and upper plate 30. The upper end of the chute as shown in FIG. 2, terminates adjacent the periphery of the pressure roll 19. Upper plate 30 is spaced beneath the feed roll 18. The plate 30 is provided with a plurality of upstanding curved fingers 31 which extends within the spaces between the resilient collars 20 on the feed roll 18, and the fingers 31 prevent the sheet being dispensed by rolls 18 and 19 from wrapping around the feed roll.

Extending downwardly from the plate 30 is a serrated cutting edge 32. After a length of the sheet 17 has been dispensed through the discharge opening the sheet is pulled outwardly causing the sheet to engage the cutting 32 to sever the sheet.

To rotate the feed roll 18 and dispense the sheet 17, a drive sprocket 33 is connected through a one-way clutch to shaft 22 which in turn is attached to feed roll 18. The shaft 22 also carries a spacer 34 which is mounted between sprocket 33 and outer support plate 35.

The sprocket 33 is formed with a series of longitudinally extending grooves 36 and 37, each of which terminates slightly beyond the longitudinal mid-point of the sprocket. The grooves are staggered, in that one groove 36 will extend from one end of the sprocket slightly beyond the mid-point while the next adjacent groove 37 will extend from the opposite end of the sprocket to a point slightly beyond the midpoint of the sprocket. Beads 38 of a bead chain 39 are received within the ends of the grooves 36 and 37 and as the chain is moved in a path of travel, the sprocket 33 will rotate to correspondingly rotate the feed roll 18. The one-way clutch mechanism associated with the interior of the sprocket 33 enables the sprocket to rotate in one direction, but rotation of the sprocket in the opposite direction will not be transmitted to the feed roll 18.

One end of the bead chain is dead-ended on a tab 40 attached to the lower end of arm 41, and the upper end of the arm 41 is journalled around the reduced diameter section 42 of hub 43. The hub 43 is mounted on a stud 44 which extends between the side wall 7 of the frame and the plate 35. The end of the stud 44 is engaged with a nut 45.

The opposite end of the bead chain 39 is dead-ended on a tab 46 attached to the lower end of an arm 47 that is journalled on the smaller diameter section 48 of collar 49. As best shown in FIG. 8, the hub 43 is provided with an extension 50 which is mounted within an opening in the collar 49.

The inner end 51 of lever 4 is also journalled around the section 48 of collar 49, and the arm 47 and lever 4 are connected by a torsion spring 53, so that downward movement of the lever arm will result in rearward movement of arm 47, as shown by the arrows in FIG. 7. The torsion spring 53 is coiled around the larger diameter portion 54 of collar 49 and one end of the torsion spring is retained by a tab 55 on lever arm 4, while the opposite end of the torsion spring is retained within the tab 56 on the central portion of the arm 47. The torsion spring 53 serves as an over-load mechanism to prevent breakage of the bead chain 39 in the event that the feed roll 18 is jammed and cannot rotate. Under these conditions, in which the feed roll 18 and the arm 47 are immovable, downward pressure on the lever arm 4 will act against the torsion spring 53 to prevent fracture of the chain 39 which is connected to the lower portion of the arm 47.

A biasing mechanism is included which acts to return the lever arm 4 to its original position after being depressed and to move the feed chain 39 to its original position. The biasing mechanism takes the form of a torsion spring 57 which is coiled around the large diameter section 58 of hub 43. One end of torsion spring 57 is connected to a tab 59 which projects laterally from side wall 7, while the opposite end of the torsion spring is retained by a tab 60 mounted on the central portion of the arm 41. The force of the torsion spring 57 will move the arm 41 to the position shown in FIG. 7, and this biasing action will be transmitted through the chain 39 and arm 47 to return the lever 4 to its original generally horizontal position.

The invention also includes a mechanism for automatically transferring the feed from a partially used stub roll to a full or fresh roll. As previously described, the full roll is retained in the upper portion of the frame 6 and is supported on the cradle 11 and tray 13. The partially dispensed stub roll 61 is supported in a cradle 62 which is spaced beneath cradle 11 and is secured to the bottom wall 9 of the frame. As best shown in FIG. 2, the forward edge of cradle 62 is provided with an outwardly extending flange or apron 63 and the end of the sheet 64 being drawn from roll 61 passes over the apron 63 and then between the feed roll 18 and pressure roll 19.

A transfer assembly, indicated generally by 65, is employed to transfer the feed on depletion of the stub roll 61 to the full roll 10. The transfer assembly 65, as best illustrated in FIGS. 2 and 5, comprises a roller 66 which is journalled on a generally horizontal rod 67 that is mounted for tilting movement on a frame 68. To enable the roller 66 and rod 67 to pivot relative to the frame, one end of the rod is bent, as indicated by 69, and is journalled within an opening in a tab 70 which is attached to frame 68. The opposite end of rod 67 is retained within a hook 71 attached to the frame. By disengaging the rod from hook 71, the roller 66 and rod 67 can be pivoted about the axis of the opening in tab 70 in a vertical plane to provide access to the components of the mechanism located beneath the transfer assembly.

The side members 72 of frame 68 are pivotally connected at their rear ends to the side wall 7 of frame 6 by pins 73.

As best illustrated in FIG. 2, a finger 74 extends downwardly from the central portion of the frame 68 and the finger is provided with a rolled lower edge 75. The finger 74 is disposed in alignment with a notch 76 formed in the apron 63 of the lower cradle 62, as shown in FIG. 5.

Figure 3:
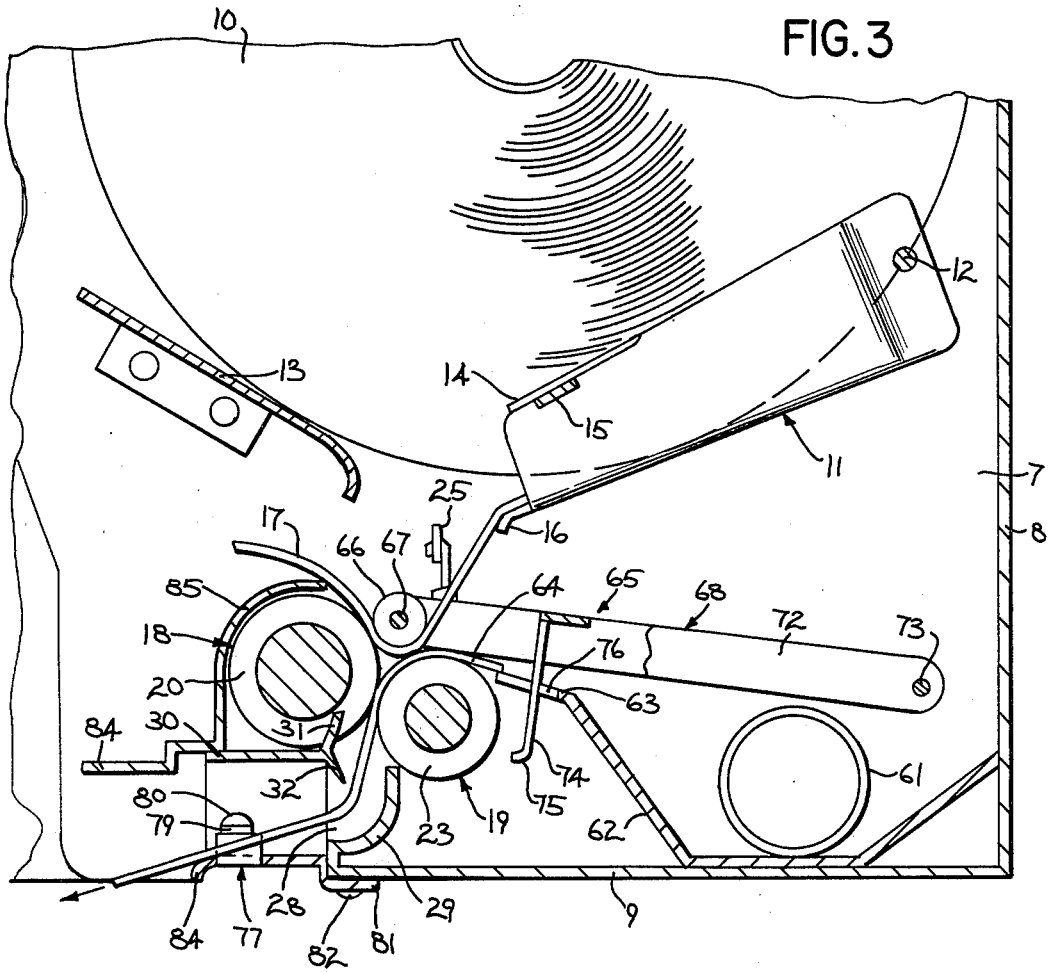
FIG. 3 is a view similar to FIG. 2 showing the completion of dispensing of the roll.

The transfer assembly 65 is biased downwardly by gravity and as the sheet 64 is dispensed from the stub roll 61, the lower end 75 of the finger 74 will ride against the sheet as it is being drawn to the feed rollers. When the stub roll has been completely dispensed and the trailing edge of the sheet 64 moves beyond the notch 76 in the apron 63, the finger 74 will drop through the notch, as shown in FIG. 3, thereby moving the roller 66 downwardly and carrying the end of the sheet 17 into engagement with the nip between rolls 18 and 19 to thereby enable the sheet 17 to be fed through the rolls to the discharge opening.

The dispenser of the invention has a provision for providing controlled feed, in which a predetermined length of sheet will be dispensed, and free feed, in which a continuous length of the sheet can be dispensed. To provide this function, a lip 77 is mounted at the lower end of the discharge openings 28 and carries laterally extending tabs 79 which are received within openings 80 in the side walls 7, to thereby permit the lip 77 to be pivoted about the axis of openings 80 between a controlled feed position, as shown in FIG. 2 and a free feed position, as shown in FIG. 11.

The lip 77 is provided with an offset flange 81 which is secured to the bottom wall 9 by screws 82 when the lip is in the controlled feed position. By disengaging the screws 82, the lip can be pivoted about the openings 80 to the free feed position, as shown in FIG. 11, and retained in this position by inserting screws 83 into openings in the forwardly extending flange 84 of roller guard 85. The upper portion of guard 85 curves rearwardly around the feed roll 18.

The opposite edge of the lip 77 is provided with a downwardly turned flange 84. With the lip in the controlled feed position, as shown in FIG. 2, the sheet is dispensed within the space between the upper plate 30 and the lip. After the given length of sheet has been dispensed through operation of lever 4, the consumer will pull outwardly on the sheet, and due to the generally horizontal position of the sheet extending through the discharge opening 28, the sheet will be severed by the serrated cutting edge 32. Thus, with the lip 77 in the controlled feed position, as shown in FIG. 2, an outward pull on the sheet will automatically sever the sheet along the cutting edge 32.

Figure 11:
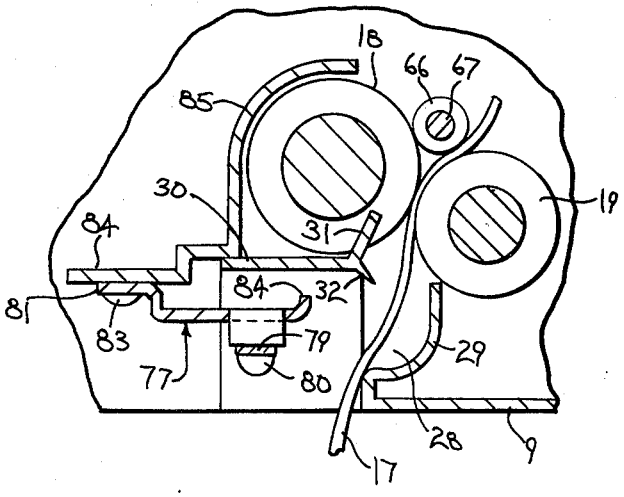
FIG. 11 is a fragmentary vertical section of the dispensing mechanism with the discharge plate in the continuous feed position.

When the lip is moved to the free feed position, as shown in FIG. 11, the sheet will be dispensed beneath the lip 77, and the sheet passing through the discharge opening will be nearly vertical. Thus, by holding the lever 4 down, a downward pull on the sheet will cause a continuous length of the sheet to be dispensed, and the user can then sever the sheet by pulling upwardly so that the sheet will engage the cutting edge 32.

OPERATION

When the full roll 10 has been dispensed to a point where it has a diameter of approximately $3\frac{1}{2}$ inches or less, the operator will remove the roll 10 from the cradle 11, while retaining the end of sheet 17 between the rolls 18 and 19. The operator then pivots the cradle 11 upwardly and pivots the roller 66 and rod 67 vertically to a storage position. The partially dispensed roll is then inserted into the lower cradle 62 and as the end of the roll is still retained between the rollers 18 and 19, the end of the sheet will drape over the apron 63. Roller 66 and rod 67 are then pivoted downwardly and the lower end 75 of finger 74 will engage the portion of the sheet located above the notch 76 and maintain the transfer assembly in the upper position as shown in FIG. 2.

The cradle 11 is then pivoted downwardly and a full roll 10 is mounted on the cradle and the free end of the sheet 17 is then draped over the roller guard 85, as shown in FIG. 2.

When the stub roll 61 has been completely dispensed, the trailing end of the sheet 64 will pass across the notch 75 in the apron 62 and as the finger is no longer supported by the sheet, the frame 68 will pivot downwardly by gravity and the roller 66 will carry the end of the sheet 17 downwardly into the nip between rolls 18 and 19, as shown in FIG. 3. Rotation of the roll 18 along with the pressure applied through the transfer assembly, will cause the sheet 17 to be fed through the rolls and into the discharge opening 28. Thus, the system provides an automatic transfer from the stub roll to the full roll.

The transfer mechanism of the invention senses the trailing end of the sheet on the stub roll, rather than sensing the diameter of the stub roll. This insures that there will be no double feeding of sheets from both the stub roll and feed rool during a period of the dispensing cycle.

The pivotable lip enables the dispenser to be used for both controlled feed and free feed. In normal installations the lip will be positioned in the control feed position, so that only a given length of towelling can be dispensed and a pull on the dispensed length will automatically sever the sheet. However, in certain installations where it is desired to feed longer or continuous lengths, the lip can be changed to the free feed position. In this position, the sheet passes beneath the lip in a generally vertical attitude so that it can be drawn downwardly to provide a longer length of sheet without contact with the cutting blade.

Various modes of carrying out the invention are contemplated as being within the scope of the following claims particularly pointing out and distinctly claiming the subject matter which is regarded as the invention.

We claim:

1. A dispenser for sheet material, comprising a housing having a discharge opening, support means disposed within the housing to support a coiled sheet of material, feeding means for feeding the sheet through said discharge opening, a cutting blade mounted adjacent said discharge opening for cutting a length of said sheet fed through said opening, a discharge member mounted for movement with respect to said discharge opening from a controlled feed position to a continuous feed position, said discharge member when in the controlled feed position directing said sheet from the discharge opening in a generally horizontal attitude, whereby a generally horizontal pull on the dispensed sheet will bring the sheet into contact with said blade to sever the sheet, said discharge member when in the continuous feed position directing said sheet from the discharge opening in a generally vertical attitude, whereby a downward pull on said dispensed sheet will not bring the sheet into contact with said blade so that a continuous length of sheet can be drawn from the dispenser said housing including an upper outlet member and a lower outlet member which are spaced apart to define said opening, said blade being connected to the upper outlet member, and means for pivoting said discharge member with respect to the housing, whereby said discharge member can be pivoted between said controlled feed position and said continuous feed position.

2. The dispenser of claim 1, wherein said discharge member when in the controlled feed position forms an extension to said lower outlet member and said discharge member when in the continuous feed position is located beneath the upper outlet member.

3. The dispenser of claim 2, wherein said feeding means comprises a pair of cooperating feed rolls and said lower outlet member is curved and extends downwardly and forwardly from the rearmost of said feed rolls.

4. A dispenser for coiled sheet material, comprising a housing having a discharge opening, support means in the housing to rotatably support a coiled sheet of material to be dispensed, feeding means for dispensing said sheet through said opening and including a pair of cooperating feed rolls, and actuating means operably connected to a first of said rolls for rotating said first feed roll and dispensing said sheet, said actuating means comprising an actuating handle to be manually operated, a sprocket connected to said first roll, and a bead chain interconnecting the actuating handle and said sprocket, said chain including a series of spaced spherical elements, said sprocket having a first group of longitudinal grooves extending from one side of said sprocket toward the longitudinal center of the sprocket and a second group of longitudinal grooves alternating with said first group and extending from the opposite side of said sprocket toward said longitudinal center, said spherical elements being disposed in the inner ends of the respective first and second groups of grooves.

5. The dispenser of claim 4, wherein the inner ends of the first and second groups of grooves overlap in a longitudinal direction.

6. The dispenser of claim 5, and including resilient connecting means interconnecting said operating handle and said chain, whereby operation of the handle when the feed rolls are immovable will act to change the configuration of said resilient connecting means to prevent damage to said chain.

* * * * *